United States Patent [19]

Pierson, Jr.

[11] Patent Number: 4,813,351

[45] Date of Patent: Mar. 21, 1989

[54] MULTIPLE COLOR SCREEN PRINTING AND CURING APPARATUS

[75] Inventor: John T. Pierson, Jr., Mission Hills, Kans.

[73] Assignee: Preco Industries, Inc., Lenexa, Kans.

[21] Appl. No.: 99,336

[22] Filed: Sep. 18, 1987

[51] Int. Cl.[4] ..... B41F 15/04

[52] U.S. Cl. ..... 101/115; 101/129; 101/416.1

[58] Field of Search ..... 101/115, 126, 129, 416 R, 101/416 A

[56] References Cited

U.S. PATENT DOCUMENTS

| | | | |
|---|---|---|---|
| 2,846,946 | 8/1958 | Schwarzberger | 101/115 |
| 3,221,646 | 12/1965 | Hardy, Jr. et al. | 101/115 |
| 4,526,101 | 7/1985 | Ericsson | 101/126 X |
| 4,671,174 | 6/1987 | Tartaglia et al. | 101/115 |

*Primary Examiner*—Clifford D. Crowder

*Attorney, Agent, or Firm*—Hovey, Williams, Timmons & Collins

[57] ABSTRACT

A screen printing and curing apparatus has a shiftable printing head that carries a plurality of screen printing units that are each adapted to print an inked image of a color or texture different than the images printed by the other printing units. After the printing head has been lowered toward a web and each printing unit produces an inked image on respective, successively oriented defined areas of the web, the printing head is raised and a curing device such as an ultraviolet lamp is moved across all of the inked images on the web. Once each image has cured, the web advances one step to bring each of the defined areas of the web into registration with the next adjacent, downstream printing unit and the cycle is then repeated to build up a multicolor or multi-textured composite image. The speed of the curing device moving across the web may be varied in order to accommodate variations in the type, color or quantity of the ink or characteristics of the printing unit, screen or web. The parameters controlling movement of the curing device over the web can be readily reprogrammed, thereby offering flexibility of operation to the user and eliminating the need for separate curing devices or driers disposed downstream of separate printing units.

13 Claims, 1 Drawing Sheet

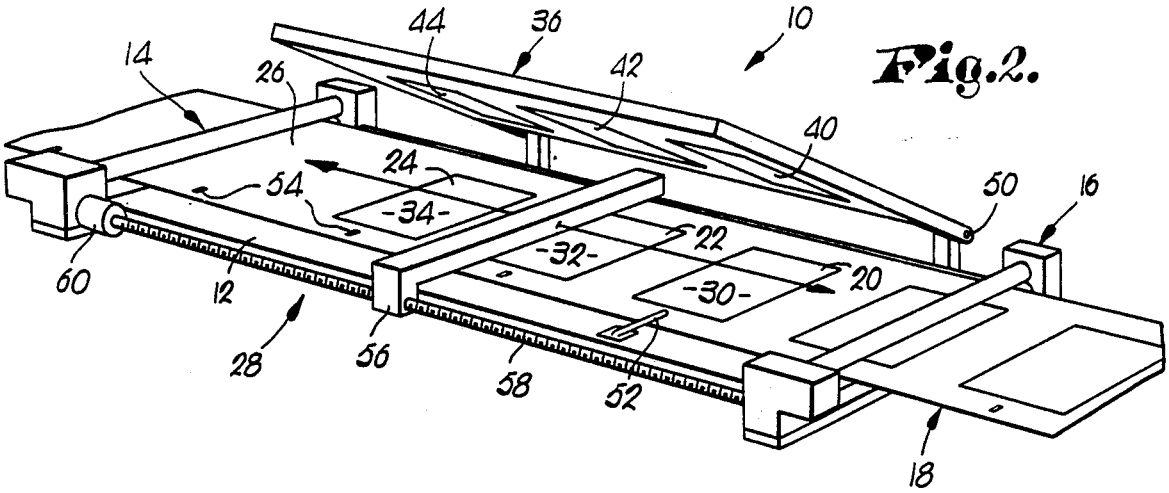
Fig. 2.
Fig. 3.
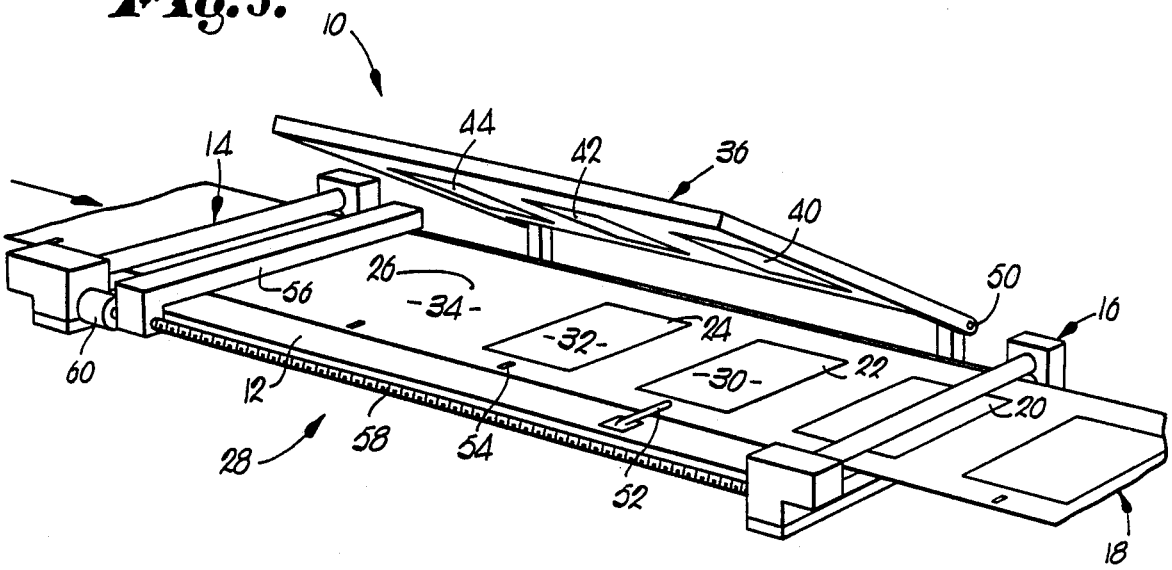
Fig. 1.
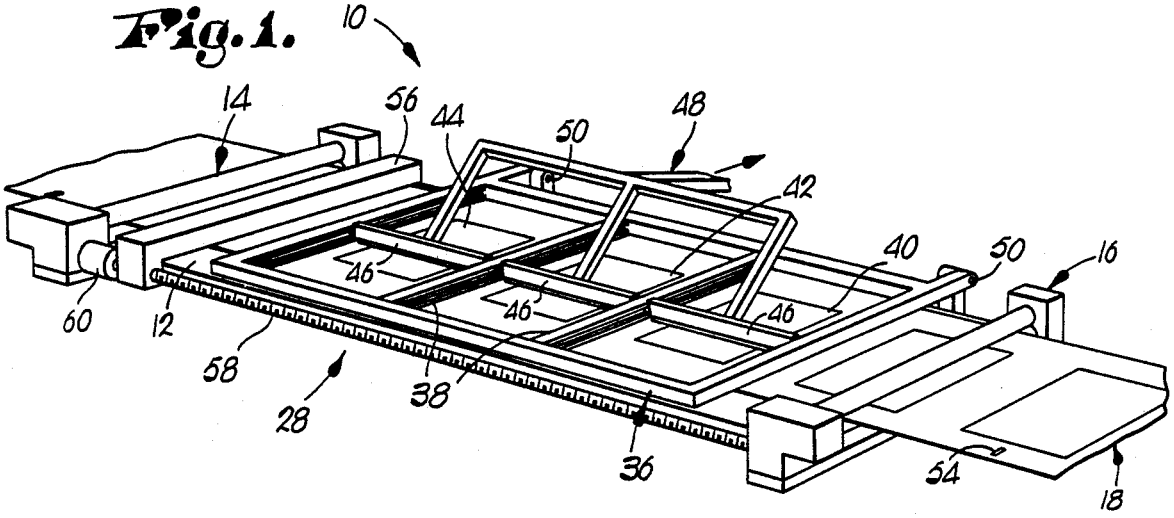

MULTIPLE COLOR SCREEN PRINTING AND CURING APPARATUS

BACKGROUND OF THE INVENTION

1. Field of the Invention

This invention relates to an apparatus and method for screen printing and curing images of multiple colors that includes a shiftable curing device which is swept across a web in close proximity to limiting inked images thereon as the web is held in a stationary position. In preferred embodiments, a screen head which is segmented to permit different colored inks to be applied in separate, segregated areas of the web is movable relative to the web supporting printing table, and the curing device is shifted across the web after the head is raised to cure all of the colored images before the web is advanced one step for subsequent printing and completion of the composite, multiple-colored image.

2. Description of the Prior Art

Conventional apparatus for printing multiple-colored images on a web is normally comprised of a number of separate screen frames or printing heads each adapted to print an image of a different color. Oftentimes, the web is advanced in step-by-step fashion so that predefined areas of the web receive ink from each of the screens until the desired composite, multi-colored image is produced. A registration system electrically interconnected with the web advancement drive is provided to cause predefined areas of the web to be brought into a desired, predetermined positional alignment with each of the printing screens as the web areas are advanced from one screen to the next.

As can be appreciated, it is normally important to insure that the inked image printed by one of the screen printing heads is dried or cured before a second colored image is printed over the first image. Otherwise, interaction between the two differently colored inks may cause the colors to run or bleed, and the sharpness of outline or contour of the composite image will be somewhat diminished. Furthermore, a portion of ink which remains wet on the web may adhere to the screen of the next adjacent, downstream printing unit, thereby causing further interaction of the inks as well as other problems.

In the past, the individual screen printing units of a multiple-colored image printing apparatus have been spaced apart a distance sufficient to allow the wet inks to dry before the images on the web are advanced to the next printing unit. However, in order to reduce the space needed between the separate printing units for applying the necessary colors, stationary heating elements or driers have been disposed between the individual printing units to hasten the curing of the inked images. One example of such construction is illustrated in U.S. Pat. No. 3,223,030 to Ranier, dated Dec. 14, 1965.

In recent years, increased interest has been directed toward inks which are cured by a source of radiation such as ultraviolet, infrared or electron beam. As an example, ultraviolet-curable ink systems offer significant advantages over conventional solvent-based systems because the curing of an ultraviolet-curable coating occurs in a fraction of the time necessary to cure coatings of conventional, heat curable inks. Compact ultraviolet curing devices conserve space in the production line and require a lower quantity of energy as compared to devices for curing an identical image by heat. Moreover, the physical and chemical properties of the ultraviolet-curable film, such as the gloss and chemical resistance of the image, equals and often exceeds in quality the characteristics of good quality conventional inks. In addition, air pollution emissions are reduced since almost all of the liquid coating is converted to solid matter and solvents are not discharged into the atmosphere.

The rate or speed of curing of ultraviolet-curable ink systems is dependent upon the chemical nature of the ink, the thickness and opacity of the coating, the type and color of the printing substrate, and the intensity and proximity of the ultraviolet curing lamp or radiation source. For example, the curing rate of an ink is related to its chemical nature, since the particular monomers of the selected ink will cure at a rate which is dependent on its composition, the nature and amount of sensitizer used, the type and amount of pigment and the quantity and nature of any additives.

The curing rates of ultraviolet ink systems are reduced as the thickness or opacity of the film is increased. The thickness of the ink film, in turn, is dependent upon a number of factors, including the screen mesh count, as the higher mesh counts with smaller openings reduce the amount of ink deposited and thereby decrease the time for curing. The thickness of the ink film is affected by the sharpness and durometer hardness of the squeegee because relatively dull or soft squeegees will result in thicker ink deposits and slower cures. The thickness of the ink deposit is also related to the amount of pressure applied to the squeegee and the angle of inclination of the same. In addition, ink film thickness is related to the thickness of the stencil layer, as heavier ink deposits are observed when the stencil is relatively thick.

The curing time of ultraviolet inks is dependent upon the type of substrate used, as substrates which are white or of a relatively light color exhibit higher reflectivities of ultraviolet light as contrasted to darker substrates. As much as a twenty percent increase in the speed of curing can be expected when images are printed with ultraviolet curable inks on white substrates as compared to comparable images printed upon black substrates.

The nature and disposition of the ultraviolet lamp or radiation source is another factor which affects the curing time for ultraviolet-curable inks. The cure rate is proportional to the square of the ultraviolet light intensity, and curing times can be thus greatly reduced by increasing the power output of the ultraviolet lamp, by focusing the radiation on the surface of the substrate by using reflectors or similar items, or by increasing the number of curing lamps. The length of time that the inked images are subjected to the ultraviolet lamps and the distance between the lamps and the substrate are two other factors which affect the rate of curing.

From the foregoing, it is apparent that a number of factors can significantly influence the curing rate of ultraviolet-curable inks, and therefore it is often a difficult proposition to pinpoint an exact curing speed for any one particular type of ink. Oftentimes, the curing rates are determined experimentally. As a consequence, it is desirable that ultraviolet curing devices be readily adaptable to substantially cure in a minimum amount of time a variety of images formed by different inks, screens or squeegees or applied to any one of a number of different types of substrates.

However, prior art screen printing apparatus having stationary driers interposed between separate screens for printing inks of different colors offer little flexibility insofar as adaption of the curing device to the type of ink, printing unit or substrate is concerned. For the most part, the web is advanced through such apparatus at a rate slow enough to insure that the slowest drying inked image is sufficiently cured.

SUMMARY OF THE INVENTION

In order to overcome the problems noted hereinabove, the present invention takes the form of a curing device such as an ultraviolet curing device that is shiftable across a web for curing a number of differently colored images as the web is held in a stationary position. The speed of travel of the curing device can thus be optionally varied as the latter moves from one inked image to another, so that the time of exposure of each inked image to the ultraviolet source can be reduced to the time necessary for adequate curing of each respective image before advancement of the web is resumed to bring the images into registration with the next adjacent, downstream, respective printing units.

Advantageously, the printing units can take the form of a single screen head having a number of dams to adapt different regions of the screen for printing images of different colors. The screen head is shiftable relative to a web supporting printing table for movement toward the latter for commencement of the printing operation, and for movement away from the table after each printing cycle is complete. A plurality of squeegees, each shiftable across a respective, segregated region of the screen are mounted on a common frame for simultaneous movement in order to apply differently colored inks to respective, predefined areas of the web therebelow.

Once the screen head has been moved downwardly to come into proximity with the web and the frame supporting the squeegees is shifted to simultaneously transfer ink from all of the segregated regions of the screen to the respective, defined web areas therebelow, the screen head is returned to a raised position and a stepper or servo motor is actuated to initiate movement of an ultraviolet lamp curing device in a direction parallel to the plane of the web and preferably parallel to the direction of advancement of the web. The ultraviolet lamp is swept by the stepper motor over all of the inked images printed during the previous printing operation, and the speed of the stepper motor is programmed as may be necessary to cause the lamp to pass over each image in a selected, minimum amount of time as may be necessary for satisfactory curing of the same. The lamp is then returned to its initial position to one side of the pivotally mounted screen head, although, optionally the lamp can be retained on opposite sides of the head after alternate curing cycles in order to eliminate the time necessary for returning the lamp to the same position to one side of the head before the next printing operation.

The provision of a shiftable ultraviolet curing device, in combination with the use of a single screen head having segregated areas for deposition of inks of different colors on the web substrate as a result of a single movement or stroke of respective squeegees, significantly reduces the overall size of the printing and curing apparatus and avoids the necessity of a number of separate curing devices each located immediately downstream of a respective printing head. Moreover, the web need not be advanced and brought to rest at a position such that each of the inked images is in registry with a respective curing device located downstream of each printing head as is the case with certain conventional apparatus.

BRIEF DESCRIPTION OF THE DRAWINGS

FIG. 1 is a fragmentary, perspective, schematic view of the multiple color screen printing and curing apparatus of the present invention, wherein is shown a printing head which has been shifted downwardly toward an elongated, flat web in order to simultaneously print images of different colors onto respective, defined areas of the web therebelow;

FIG. 2 is a view substantially similar to FIG. 1 except that the printing head has been raised to enable passage of a radiation emitting curing device across the web for curing of the images thereon; and FIG. 3 is a view substantially similar to FIGS. 1 and 2 except that the curing device has been returned to its initial position and the web has been advanced one step to move the web defined areas toward a position in registry with the next adjacent, downstream, segregated region of the printing screen so that a multi-color, composite image is printed on each defined area of the web.

DETAILED DESCRIPTION OF THE DRAWINGS

A multiple color screen printing and curing apparatus, broadly designated 10, is shown in FIGS. 1–3 and includes framework that carries a web supporting printing table 12. A pair of roll feeds 14, 16 are disposed on opposite ends of the elongated, flat table 12 and provide a means for longitudinally advancing an elongated, flat web 18 having a number of successive, separate defined areas, four of which have been numbered 20–26 for illustrative purposes. The top of the table 12 serves as structure defining a printing or work station 28 having three defined work regions 30, 32, 34 disposed along the length of table 12 and the web 18 thereabove.

A screen printing head 36 has intermediate dams 38 which divide the head 36 into three printing units 40, 42, 44 that each correspond to one of the work regions 30, 32, 34 respectively. Each of the printing units 40–44 is adapted to print an inked image of a color or texture different than the images to be printed by the remaining printing units, 40–44 as may be desirable for creating a multi-color or multi-texture composite image on the web 18 therebelow. In this regard, it is to be understood that the number of printing units 40–44, as well as the corresponding work regions 30–34 may vary from that which is shown in the drawings for exemplary purposes. Also, the dams 38 may be laterally shifted in order to vary the width of the printing units 40–44, or alternatively an additional dam 38 may be provided to establish an additional segregated area where four different colors are to be printed.

Three applicators or squeegees 46, each corresponding to one of the printing units 40–44, are connected by arms to a common frame 48 for movement across the screen in the direction shown by the arrow in FIG. 1. The squeegees 46, during printing, thereby move in a direction perpendicular to the direction of advancement of the web 14.

As illustrated in FIGS. 1–3, the screen printing head 36 is coupled by two pivots 50 connected to the framework supporting the table 12 for swinging movement of the printing head 36 about a horizontal axis that is parallel to the plane of the web 18 and the table 12. Drive linkage or other mechanism connected to the printing head 36 enables the head 36 to simultaneously shift the printing units 40–44 toward a corresponding one of the work station regions 30–44 respectively for printing an image on one of the defined areas 20–26 of the web 18 therebelow.

The apparatus 10 also includes a registration system that comprises a photo-electric detector 52 connected to the table 12. The detector 52 is operable to sense registration marks 54 that each correspond to one of the defined areas 20–26 of web 18. More particularly, each of the registration marks 54 is disposed on the web 18 at a predetermined location relative to the corresponding web defined area 20–26 in horizontal directions both laterally and longitudinally of web 18.

During advancement of the web 18 across table 12, the photo-electric detector 52 awaits arrival of the next adjacent, upstream registration mark 54 and a controller interconnecting the photoelectric detector 52 and the roll feeds 14, 16 deactiviates the latter to interrupt advancement of the web 18 once the next registration mark 54 has moved into adjacent relationship with the photoelectric detector 52. As a result, the registration system is operable to bring each of the web defined areas 20–26 successively into registry with work station regions 30–34 during each cycle of the printing operation which is explained in more detail below.

An ink curing device 56 preferably takes the form of an ultraviolet lamp, although other types of curing devices, such as those emitting infrared radiation or an electron beam are also possible. The ink curing device 56 is threaded onto an elongated lead screw 58 that extends between the roll feeds 14, 16 along the length of table 12. In turn the lead screw is rotatable about a horizontal axis in either direction by a stepper motor 60.

The stepper motor 60, in cooperation with the lead screw 58, provides a means for shifting the ink curing device 56 across the web 18 in a direction parallel to the direction of advancement of the latter. The ink carrying device 56 crosses each of the work station regions 30–34 to cure printed images on the web 18 that have been produced by the segregated regions or printing units 40-44 of screen printing head 36.

Operation

In use, roll feeds 14, 16 advance the web 18 until the next registration mark 54 is sensed by detector 52. Once the controller interconnecting the registration system and the roll feeds 14, 16 deactivates the latter to interrupt advancement of the web, three defined areas of the web 18, such as areas 20–24 are in registry with work regions 30–34 and the printing units 40–44 respectively.

Next, the screen printing head 36 is moved in an arc about pivots 50 to bring each of the printing units 40–44 into close proximal relationship to defined areas 20–24 of web 18. The frame 48 is then shifted to move the applicators or squeegees 46 simultaneously across each of the printing units 40–44, and thereby establish an inked, printed image on the defined areas 20–24 respectively of the web 18 therebelow.

Next, the screen printing head 36 is raised by swinging the same about pivots 50 until reaching the position shown in FIG. 2. The stepper motor 60 is then activated to rotate lead screw 58 and advance the ink curing device 56 across the web 18 in either of the two directions as indicated by the arrows.

Advantageously, the speed of the stepper motor 60 is precisely controlled by a control system so that the velocity of the curing device 56 is maintained within a range sufficient for adequately curing the inked images on the web 18 in the smallest practical time period. To this end, therefore, the velocity of the stepper motor 60 may be varied in order to increase or decrease the speed of the ink curing device 56 across the web 18 in accordance with the type, quantity or color of ink applied to each of the web defined areas 20–24. For example, the rotative speed of stepper motor 60 may be decreased as the ink carrying device passes over the web defined area 22 if an increased amount of time is necessary to dry the printed image thereon relative to the time necessary to dry images printed on web areas 20, 24.

After the ink carrying device 56 has swept across all of the inked images printed on the web defined areas 20–24, the curing device 56 moves away from the screen printing head 36 until reaching a location either upstream or downstream of the latter. In this regard, the stepper motor 60 may be controlled so that the curing device 56 after one cycle of printing by head 36 moves to one end of the screen printing head 36 and then retracts in the opposite direction after the next cycle of printing to thereby avoid the time required for returning the ink carrying device 56 to its initial position after the curing operation is completed. Alternatively, the curing device 56 may be returned to the same position after each curing operation, with the lamp of the device 56 either activated or deactivated during its return stroke as may be desired.

Once the curing device 56 has come to a rest position, such as the position shown in FIGS. 1 and 3, the controller again activates the roll feeds 14, 16 to longitudinally advance the web 18 one step or progression which is equal to the distance between next adjacent registration marks 54. As soon as the photo-electric detector 52 senses the arrival of the next adjacent registration mark 54, the controller interrupts power to the roll feeds 14, 16 to halt further movement of the web 18. As a consequence, the web 18 has been advanced one step or progression to the disposition illustrated in FIG. 3, such that the web defined areas 22, 24, 26 are now in registration with work stations 30–34 and printing units 40–44 respectively.

Next, the screen printing head 36 is again lowered as depicted in FIG. 1 and the entire cycle is resumed. In this manner, all of the defined areas of the web 18 receive ink from each of the printing units 40–44 in order to build up a number of multi-color, composite images.

As can now be appreciated, the provision of a shiftable curing lamp such as device 56 greatly simplifies and reduces the overall size of apparatus 10, since a separate drier or curing device corresponding to each printing unit is unnecessary. Moreover, the control system for the stepper motor 60 can be programmed to insure that the ink of each image is sufficiently cured before the web defined areas 20–26 are advanced to the next adjacent, downstream printing unit 40–44. The control system for the stepper motor 60 can be readily reprogrammed to accomodate variances in the type or color of ink, thickness or mesh count of the screen or characteristics of the web 18.

While the foregoing is a detailed description of a currently preferred embodiment of the invention it is understood that those skilled in the art may make various modifications or additions to the apparatus 10 shown in the drawings without departing from the essence of my contribution to the art. For example, the number of printing units may vary from the three units 40, 42, 44 illustrated, and if desired only one of the roll feeds 14, 16 may be employed. Also, a web encoder may be used instead of the photo-electric detector 52. Consequently, the invention should be deemed to be limited only by a fair scope of the claims which follows.

I claim:

1. Screen printing apparatus for printing multiple-colored or multi-textured images on predefined, successive areas of an elongated, generally flat web comprising:

structure presenting a work station having a number of defined work regions;

means for longitudinally advancing the web through said work station, and said advancement means being operable to interrupt web advancement at time intervals causing the predefined areas of said web to be sequentially and successively brought into exact registration with respective work regions;

a plurality of screen printing units each corresponding to one of said number of work regions for printing an inked image having at least one of a certain color or of a certain texture, each of said printing units being collectively operable to print an inked image of a color or texture different than the images to be printed by the remaining printing units;

means for shifting all of said printing units as a group toward said work station regions for printing images on the predefined areas of said web corresponding to respective colors when said web areas are in registration with said work regions, and for shifting said printing units as a group away from said respective work station regions subsequent to printing of images on said web;

means for thereafter resuming the advancement of said web for bringing, each of the predefined web areas into registration with the next adjacent work region in the direction of advancement of the web for subsequent printing thereon by a respective printing unit;

an ink curing device shiftably mounted on said work station defining structure for movement across all of the work regions; and means for shifting said ink curing device across said web in a direction generally parallel to the plane of said web for curing of all of said printed web images on said predefined web areas in successive order before the latter receive ink from the printing units during the next cycle of operation thereof.

2. The invention as set forth in claim 1, wherein said means for shifting said ink curing device across said web includes means for controlling the velocity of said ink curing device as the latter moves over each predefined web area to another in order to permit selective variation of the length of time the curing device is over each defined area so that such curing time is sufficient to substantially cure each image printed thereon in accordance with the type, quantity or color of said ink.

3. The invention as set forth in claim 1, wherein each of said printing units are mounted on a common head for simultaneous movement toward and away from said regions of said work station.

4. The invention as set forth in claim 3, wherein each of said printing units are provided with an ink applicator movable during printing in a direction generally transverse to the direction of longitudinal advancement of said web.

5. The invention as set forth in claim 3, wherein said head is pivotally connected to said structure defining said work station for swinging movement about an axis generally parallel with the direction of advancement of said web.

6. The invention as set forth in claim 1, wherein said means for shifting said curing device across said web comprises a stepper motor.

7. The invention as set forth in claim 1, wherein said means for shifting said ink curing device across said web includes means for moving said device initially in a certain direction for curing printed images on said web, and then in a direction opposite to said certain direction for curing subsequently printed images.

8. A method of printing multiple-colored images on an elongated, generally flat web comprising the steps of:

advancing said web in a generally longitudinal direction in order to bring predefined areas of said web sequentially and successively into exact registration with respective defined regions of a work station;

shifting toward said work station a plurality of screen printing units as a group each adapted for printing an inked image of a color or texture different than the colors or textures of inked images to be printed by the other screen printing units;

printing on said predefined web areas at said regions of the work station an image by a respective one of said printing units;

shifting away from said work station said plurality of printing units as a group after all of said images have been printed thereon;

moving an ink curing device across said web and in a direction substantially parallel to the plane of said web in proximity to said printed images for curing all of the images thereon; and resuming advancement of said web in a generally longitudinal direction in order to bring the predefined web areas into registry with next adjacent downstream, defined regions of said work station for subsequent printing by all of the printing units in the next cycle of printing thereof.

9. The invention as set forth in claim 8, wherein said step of moving an ink curing device across said web includes the step of controlling the velocity of said ink curing device as the latter moves over each of the regions in order to permit selective variation of the length of time the curing device is over each defined area so that such curing time is sufficient to cure each image in accordance with the type, quantity or color of said ink.

10. The invention as set forth in claim 8, wherein said step of printing said images includes the step of moving an ink applicator across said web in a direction generally transverse to the direction of advancement of said web.

11. The invention as set forth in claim 8, wherein said step of shifting said screen printing units toward said work station occurs in such a fashion that all of said units move simultaneously with one another on a common printing head.

12. The invention as set forth in claim 11, wherein said step of shifting said units toward said web includes the step of swinging said printing head in an arc about a reference axis generally parallel to the plane of the web.

13. The invention as set forth in claim 8, wherein said step of moving said ink curing device across said web includes the step of moving said device in a certain direction for curing of images, and then moving said device in a direction opposite to said certain direction for curing subsequently inked images.

* * * * *